United States Patent [19]

Bjerking et al.

[11] Patent Number: 4,765,416

[45] Date of Patent: Aug. 23, 1988

[54] METHOD FOR PRUDENT PENETRATION OF A CASING THROUGH SENSIBLE OVERBURDEN OR SENSIBLE STRUCTURES

[75] Inventors: Sven-Erik Bjerking; Sven-Goran Andersson, both of Upsala, Sweden

[73] Assignee: AB Sandvik Rock Tools, Sandviken, Sweden

[21] Appl. No.: 869,697

[22] Filed: Jun. 2, 1986

[30] Foreign Application Priority Data

Jun. 3, 1985 [SE] Sweden ..... 8502723

[51] Int. Cl.[4] ..... E21B 10/26; E21B 10/60; E21B 21/00

[52] U.S. Cl. ..... 175/71; 175/385; 175/393; 175/257

[58] Field of Search ..... 175/422 R, 257, 393, 175/340, 418, 417, 385, 72, 69, 71, 67, 424

[56] References Cited

U.S. PATENT DOCUMENTS

| | | | |
|---|---|---|---|
| 2,765,146 | 10/1956 | Williams, Jr. | 175/422 R X |
| 2,805,043 | 9/1957 | Williams, Jr. | 175/422 R X |
| 2,807,443 | 9/1957 | Wyman | 175/418 X |
| 3,011,547 | 12/1961 | Holbert et al. | 175/72 X |
| 3,011,571 | 12/1961 | De Bree et al. | 175/418 X |
| 4,043,409 | 8/1977 | Walter | 175/422 R X |
| 4,222,447 | 9/1980 | Cholet | 175/340 |
| 4,610,321 | 9/1986 | Whaling | 175/422 R |

FOREIGN PATENT DOCUMENTS

| | | |
|---|---|---|
| 0106702 | 4/1984 | European Pat. Off. . |
| 2407336 | 5/1979 | France . |
| 83017186 | 9/1984 | Sweden . |

*Primary Examiner*—Stephen J. Novosad

*Attorney, Agent, or Firm*—Burns, Doane, Swecker & Mathis

[57] ABSTRACT

In a subterranean drilling operation, a drill stem and drill bit are advanced downwardly while conducting compressed air downwardly through the drill stem. A minor part of the air flow is discharged from the drill bit downwardly against the sensible overburden, and a major part of the air flow is discharged upwardly through passages in the drill stem. A casing is disposed around the drill stem and advanced therewith so that the sensible overburden is shielded from the air discharged from the upwardly directed passages. The upwardly directed passages contain removable inserts which can be exchanged for different inserts in order to vary the amount of air discharged from the upwardly directed passages, and thereby vary the amount of air discharged downwardly from the drill bit against the overburden. In that way, the amount of air acting against the overburden can be adapted to the type of material in the overburden in order to control the amount of disruption to the overburden.

1 Claim, 5 Drawing Sheets

METHOD FOR PRUDENT PENETRATION OF A CASING THROUGH SENSIBLE OVERBURDEN OR SENSIBLE STRUCTURES

BACKGROUND OF THE INVENTION

The present invention relates to a method and a device for driving down casings to undisturbed ground without essentially displacing or spoiling sensible overburden and sensible structures. In the casings piles or the like can be driven down for foundation or anchoring in more solid ground.

Sensible overburden is for instance cultural layers from earlier civilizations that can be found under the ground surface having a thickness of up to 3 m. The cultural layers are a source of knowledge for the archeologist to learn about life and human beings during earlier epoches. The cultural layers are in some countries protected by law and must not be ruined.

Sensible structures are for instance walls of unhewn stone for older buildings, especially while works are going on for reinforcing the fundament or sheet piling in or adjacent to the structures. These works must be carried out very carefully if no permanent damage shall occur.

The main characteristics of the invention are that a drilling device that is operated by compressed air is surrounded by a casing, said drilling device at its lower end being provided with adjustable exhaust channels that direct the major part of the compressed air upwards to lead it away between the drill stem and the casing together with the cuttings. Due to the fact that the exhaust channels are adjustable, the intensity of the part of the compressed air directed downwards toward the drill bit can be adapted to the nature of the material that is penetrated. By jet action said part of the compressed air can be led upwards along the grooves on the side walls of the drill bit. The invention also relates to the design of these grooves having a lower narrow inlet and an upwards continuously increasing area. Said design makes it impossible for the cuttings to stick on their way upwards.

THE DRAWING

A preferable embodiment of the invention is described in the following with reference to the enclosed drawings where FIG. 1 discloses a longitudinal section of the device according to the invention;

FIGS. 1A–1E disclose sections along A, B, C, D and E in FIG. 1;

DETAILED DESCRIPTION OF A PREFERRED EMBODIMENT OF THE INVENTION

Figure 1:
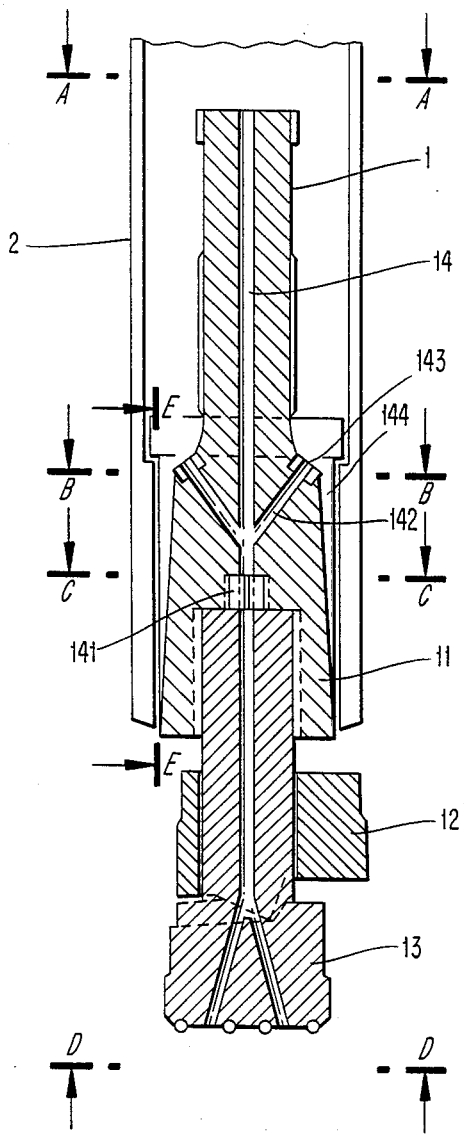
Figure 1A:
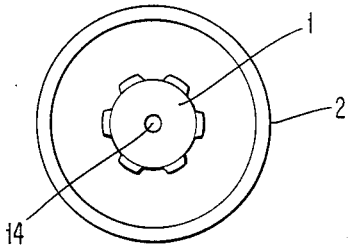
Figure 1B:
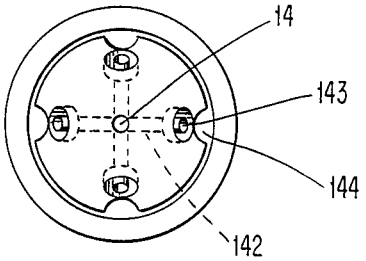
Figure 1C:
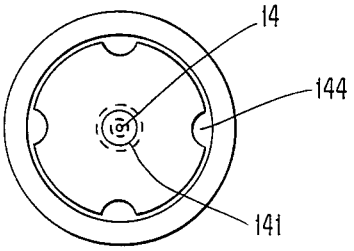
Figure 1D:
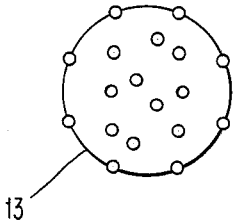

FIG. 1 discloses in section a device for overburden drilling comprising a rotating drill 1, that is surrounded by a casing 2. The lower part of the drill, i.e. the drill bit, is shown in the figures as a separate detail. The drill bit is assembled of a guiding device 11, reamer 12 and pilot bit 13. The drill also comprises an exhaust channel 14 for the compressed air operating the drill. These details are known per se. According to the invention the exhaust channel 14 is provided with a control valve 141. Above this control valve 141 there are exhaust channels 142 for the main part of the compressed air, said exhaust channels 142 being provided with flow conducting inserts 143 having passages whose areas are adapted to the material that the device is to penetrate. The inserts 143 are accessible for exchange in order to carry out a coarse adjustment, if necessary, before starting a new drilling cycle. The minor part of the compressed air, that passes through the control valve 141 for prudent flushing around the drill tip, thereafter is sucked upwards along grooves 144 on the side walls of the drill bit through jet action from the compressed air that is rushing out directed upwards from the exhaust channels 142 through the inserts 143. By having the grooves 144 designed with a narrow lower inlet and a gradually upwards increasing area, the cuttings can never stick anywhere on their way upwards and obstruct the channels.

Figure 2:
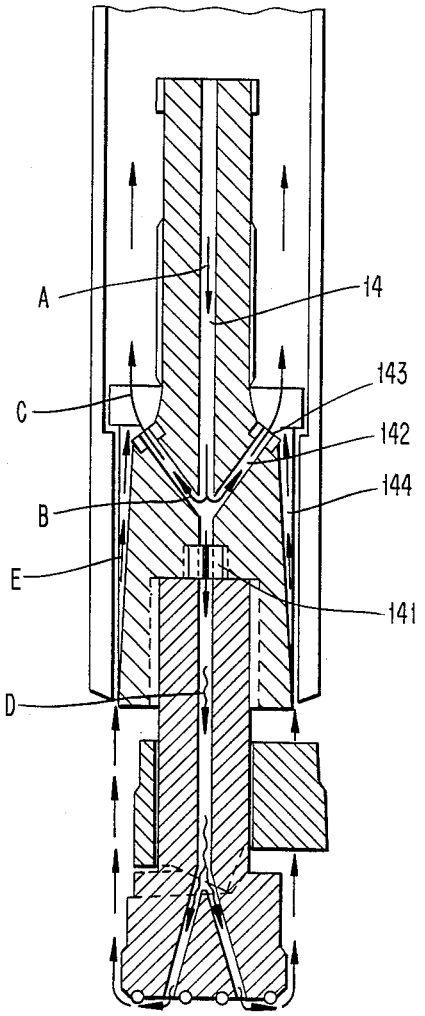
FIG. 2 is a view corresponding to FIG. 1 showing the flowing of the compressed air.
Figure 1E:
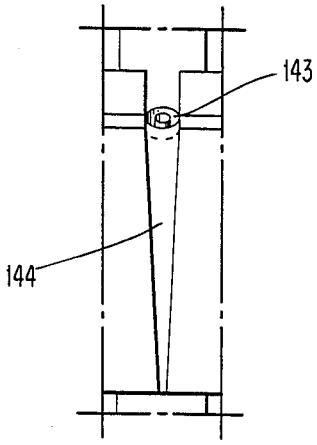

FIG. 2 discloses in section the way of the compressed air through the drill. The compressed air is with great power rushing through the exhaust channel 14 (arrow A) and is to a major extent pushed backwards by the constriction in the control valve 141. The air then continues through the upwards inclined exhaust channels 142 having inserts 143 (arrow B) and then further upwards together with the cuttings between the drill shank and the casing (arrow C). The minor part of the compressed air, that flows through the control valve 141 (arrow D) for prudent flushing around the drill tip, is sucked upwards along the grooves 144 in the side walls of the drill bit (arrow E) through jet action from the compressed air that is rushing out in an upward direction from the exhaust channels 142 through the inserts 143.

Figure 3:
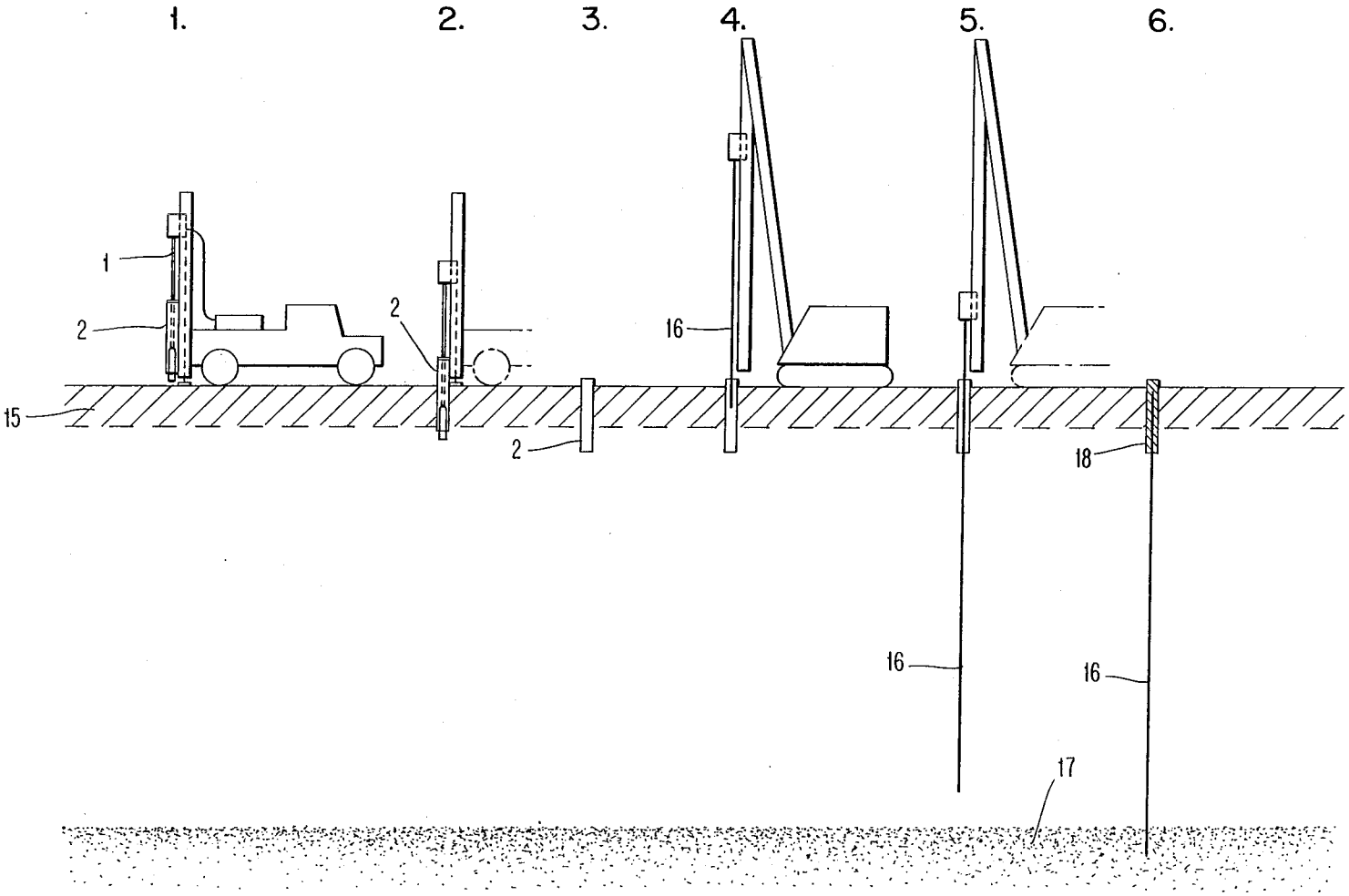
FIG. 3 illustrates schematically the different working phases when piling in a sensible overburden.

FIG. 3 discloses the different working phases when the casing and the drill is driven down into the overburden 15 to a level just below the lower edge of the cultural layer. After the drill has been drawn up piling can take place through the casing without disturbing the cultured layer.

Phase 1

Mobile drill tower with casing 2 and drill 1 mounted, the tower being moved to the drill site.

Phase 2

The casing 2 is displaced downwards into the overburden through the cultured layers.

Phase 3

The casing 2 is driven down in the overburden to a level just below the lower edge of the cultural layers.

Phase 4

A pile 16 is lowered into the casing.

Phase 5

The pile 16 is driven down into the overburden to a predetermined depth.

Phase 6

The pile 16 has reached the predetermined depth (driven to a stop in friction material) and then cemented 18 in the casing.

FIGS. 4A to 4D disclose the different working phases when the casing and the drill are driven down through a fundament of unhewn stone.

Figure 4A:
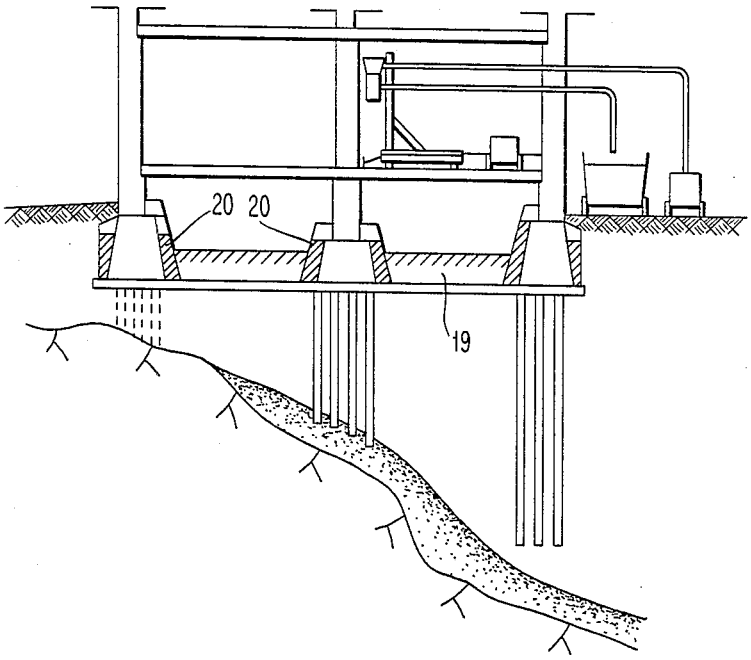
FIGS. 4A–4D illustrate schematically the different working phases when piling sensible fundaments for reinforcing buildings.

Phase 1 (FIG. 4A)

When the fundament 19 has been reinforced in certain areas 20 the drilling device can be entered on the floor above the base fundament.

Figure 4B:
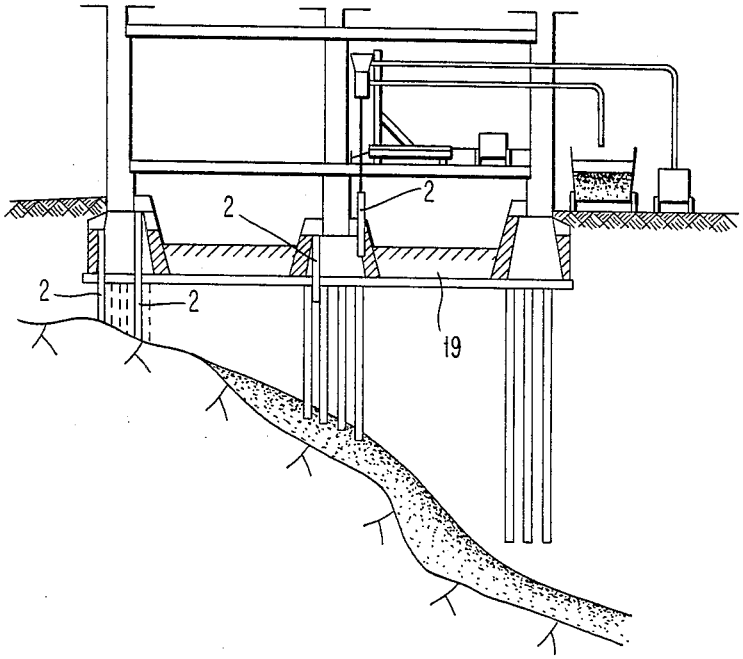

Phase 2 (FIG. 4B)

Casings 2 are driven through the fundament 19 down to a level just below the lower edge of the fundament 19.

Figure 4C:
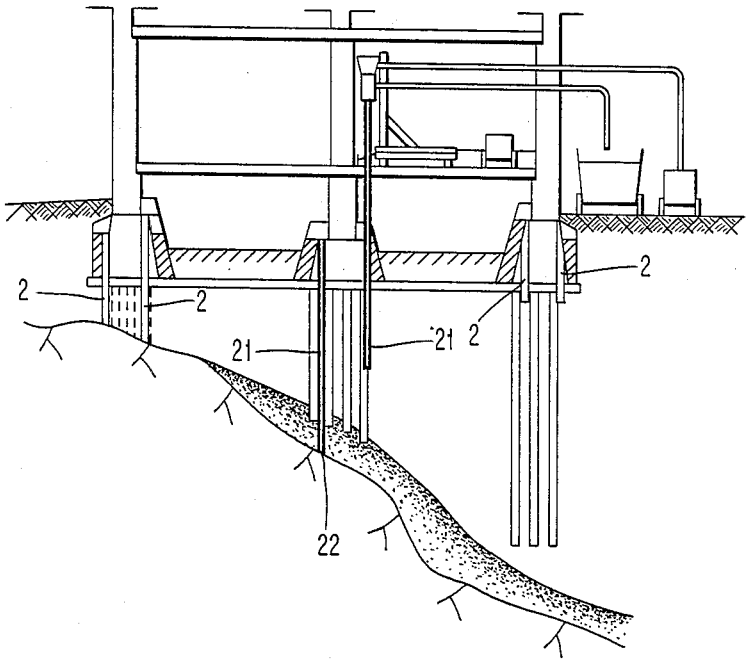

Phase 3 (FIG. 4C)

Steel piles 21 are driven down through the casings 2 until the end 22 of the piles 21 bear against the rock.

Figure 4D:
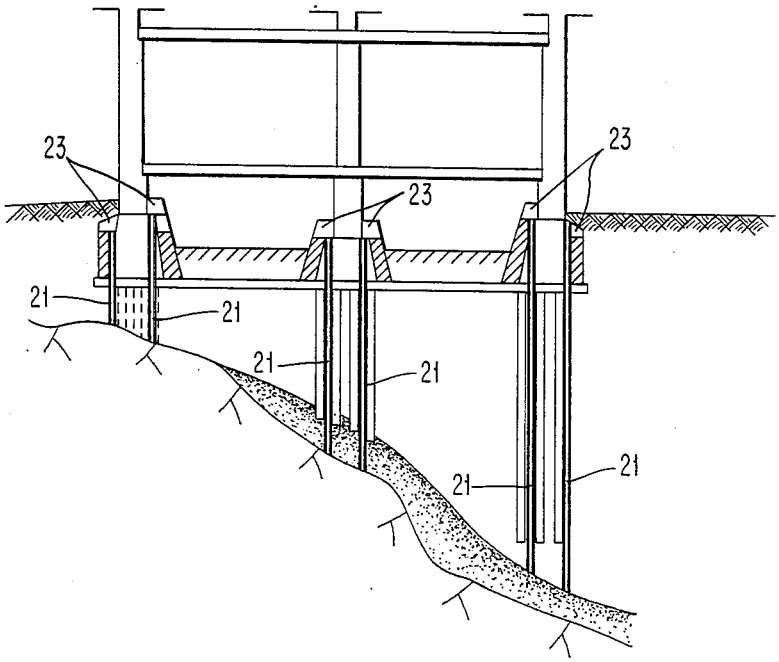

Phase 4 (FIG. 4D)

After the steel piles have been driven down to a stop the drilling device is taken away. The damages of the fundament caused by the drilling are filled with concrete 23.

The invention is of course not restricted to the above described embodiments but many modifications are possible within the scope of the appending claims.

We claim:

1. In a method of drilling through sensible overburden, comprising the steps of downwardly advancing a drill stem having a drill bit and simultaneously advancing therewith a casing disposed around said drill stem, while conducting compressed air through said drill bit and discharging said compressed air simultaneously through downwardly directed discharge passage means at a lower end of said drill bit, and through a plurality of upwardly directed discharge passages disposed above said lower end and which discharge the air into a space disposed between said drill string and said casing, whereby a major part of the compressed air flows through said upwardly directed discharge passages and a minor part of said pressurized air is directed through said downwardly directed discharge passage means to engage said overburden and then be sucked upwardly along a side wall of said drill bit by the action of said compressed air discharged through said upwardly directed discharge passages, said casing shielding the sensible overburden from air discharged from said upwardly directed passages, the improvement comprising the steps of providing in at least some of said upwardly directed discharge passages a removable insert having a through-passage therein, and exchanging said inserts with different inserts in order to vary the amount of pressurized air which is directed through said upwardly directed discharge passages and thereby vary the amount of pressurized air which exists said downwardly directed discharge passage means and into contact with said sensible overburden in accordance with the type of material in the overburden, whereby the amount of air contacting said sensible overburden is adapted to the type of material in said sensible overburden in a manner controlling the amount of disruption to said sensible overburden.

* * * * *